US005268824A

United States Patent [19]

Czipri

[11] Patent Number: 5,268,824

[45] Date of Patent: Dec. 7, 1993

[54] MANUALLY OPERATED BOAT LIGHT

[75] Inventor: John Czipri, Clearwater, Fla.

[73] Assignee: Accon, Inc., Clearwater, Fla.

[21] Appl. No.: 20,746

[22] Filed: Feb. 22, 1993

[51] Int. Cl.[5] ..... B63B 45/06

[52] U.S. Cl. ..... 362/61; 362/269; 362/287; 362/365

[58] Field of Search ..... 362/61, 63, 80, 269, 362/285, 288, 365, 368, 427, 428, 287

[56] References Cited

U.S. PATENT DOCUMENTS

| | | | |
|---|---|---|---|
| 17,545 | 12/1929 | Nenzel | 362/269 |
| 1,468,727 | 9/1923 | Mullard et al. | 362/365 |
| 2,198,077 | 4/1940 | Curtis | 362/269 |
| 3,007,040 | 10/1961 | Schwartz | 362/269 |
| 3,042,798 | 7/1962 | Copping | 362/364 |
| 3,833,800 | 9/1974 | Stewart et al. | 240/7.5 |
| 3,836,760 | 9/1974 | Robinson | 240/10 R |
| 4,445,163 | 4/1984 | Ziaylek, Jr. | 362/61 |
| 4,600,978 | 7/1986 | Kimura | 362/269 |
| 5,145,249 | 9/1992 | Bruckner | 362/365 |

*Primary Examiner*—Richard R. Cole
*Assistant Examiner*—Y. Quach
*Attorney, Agent, or Firm*—Harold D. Shall

[57] ABSTRACT

A navigation light for a boat including a base plate mounted over a hole in the deck, hull or cabin of a boat. The base plate has an opening in which is pivotally mounted a bulb carrying insert with the insert being moveable between a flush position and a projecting position relative to the base plate. A first and second spring means holds the insert in its projecting and flush position respectively.

3 Claims, 2 Drawing Sheets

MANUALLY OPERATED BOAT LIGHT

BACKGROUND OF THE INVENTION

This invention relates to boat lights generally, and more particularly to navigation lights which have a depressed, flush inoperative position and an upright exposed position wherein they may be activated to provide navigation light, and are manually movable between such positions.

Boat lights for navigation have been in use for many years and in fact are currently required on certain size boats by U.S. Coast Guard regulations. The forwardly facing boat lights are red and green. If such light is on the bow of the boat, called a bow light, it usually is a combined red and green light with the green light pointing to the right or starboard and the red light pointing to the left or port of the boat. If the light is hull or cabin mounted, and hereinafter referred to as a side light, there is a separate light mounted on the side of the hull or side of the cabin with the light on the starboard side being green and the light on the port side being red.

With prior art navigation lights of the above type, the light housing projects above the deck if it is a bow light, and if it is a side light it projects from the side of the cabin or hull whether or not in use. The lights of the instant invention, when in an operative position, project from the deck, hull or cabin where they are mounted and such an exposed light provide a hazard, since the deck or cabin mounted light may be tripped over, bumped into or entangled while the hull mounted light may strike a dock, piling or the like and cause damage thereto or to the boat. It is therefore desirable to have a base plate which is secured to the deck, cabin or hull, which base plate contains a light-carrying insert with the insert being manually movable between a flush position and a projecting position and having resilient means holding the light in either of its two positions.

SUMMARY OF THE INVENTION

The present invention provides a forwardly facing navigation light for a boat including a deck, hull or cabin mounted base plate in which is pivotally mounted a light carrying insert, which insert has a depressed or flush position within the base plate, and including resilient means for holding the insert in such position when the light is not in operation and with the insert being manually pivotable to a projecting operative position and with said resilient means holding the insert in such operative position.

DETAILED DESCRIPTION

Figure 1:
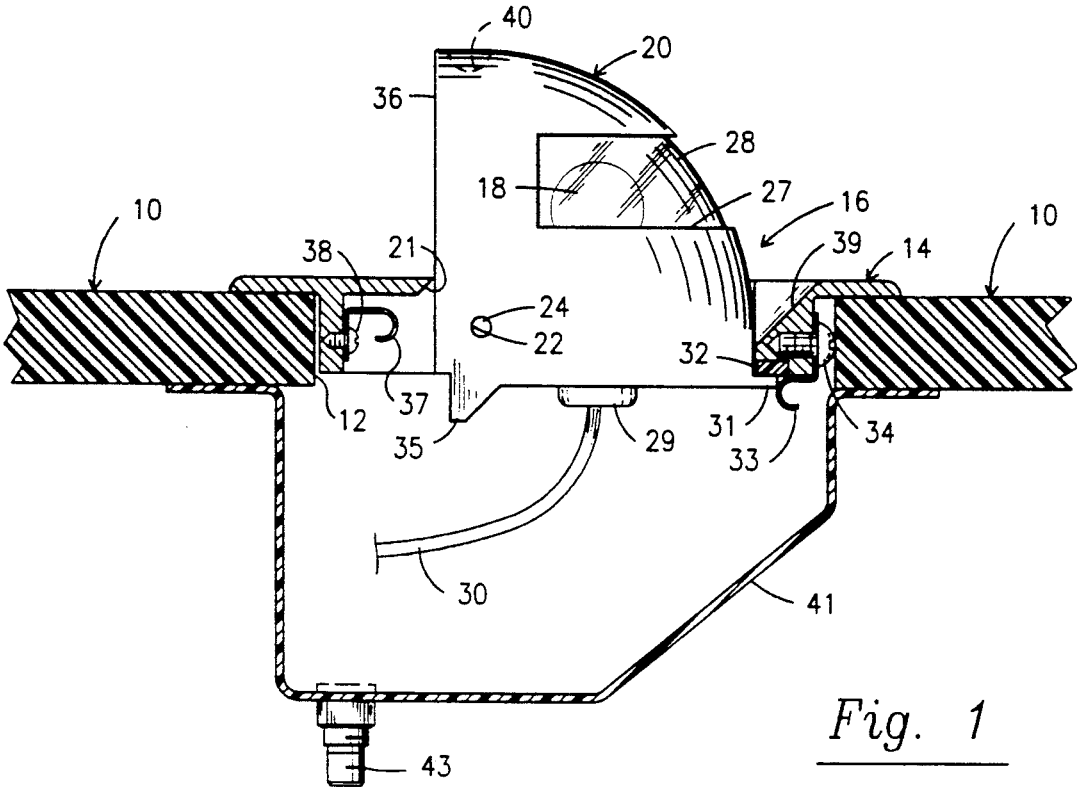
FIG. 1 is as side view of a first embodiment of this invention, a bow light with the base plate and water retention cup shown in section and with the insert in its operative or projecting position and being shown in full lines.
Figure 2:
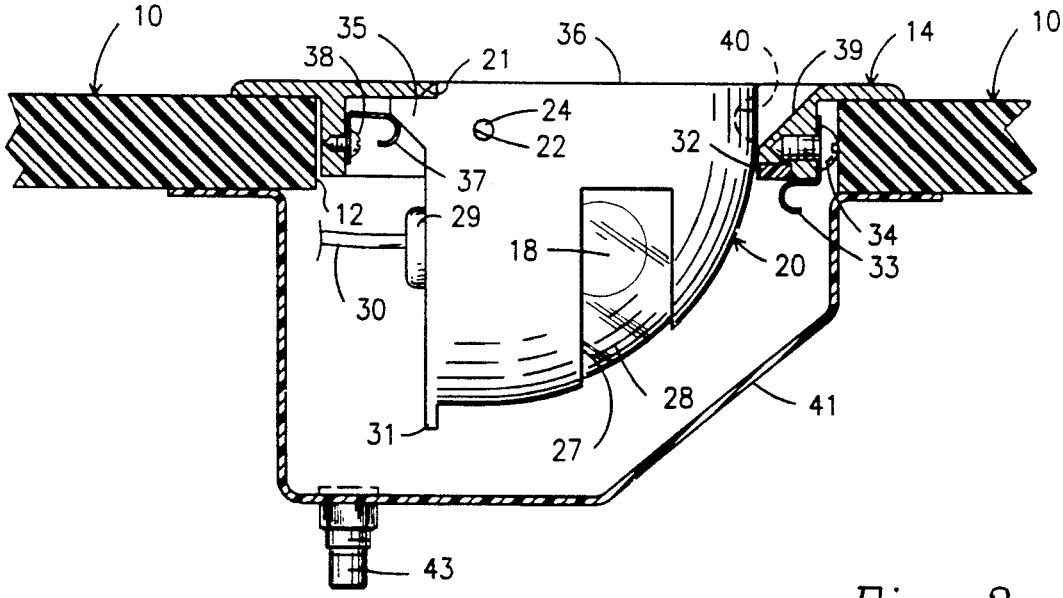
FIG. 2 is a side view taken like FIG. 1 with the insert in its flush inoperative position.
Figure 6:
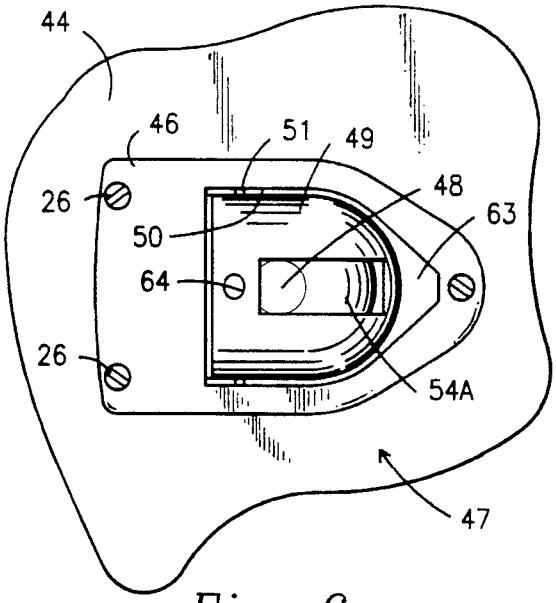
FIG. 6 is a side view of the embodiment of FIG. 3 showing the insert in its flush position.

Referring now to the drawings and more particularly to FIGS. 1 and 2, a boat deck at the bow of a boat is shown generally at 10 and has an opening 12 therein. Inserted in the opening 12 is a base plate 14 of a bow light assembly 16 which also includes a bulb 18 carrying insert 20. The base plate 14 is secured to the deck 10 as by a plurality of screws 26 as shown in FIG. 6, which screws pass through a flange of said base plate and into the deck. The insert 20 is pivotally mounted in a registering opening 21 in the base plate 14 by a pivot pin 24 which passes through an opening 22 extending transversely through the insert at the lower rear end thereof. The insert 20 has a forwardly facing, transversely extending horizontal slot 27 formed therein, which slot extends for two hundred and twenty five degrees from side to side. The slot 27 is covered by a plastic shield 28, and the shield is green on the starboard side thereof and red on the port side thereof. Light from the bulb 18 shines out of the slot 27 through the colored shield 28. The base (not shown) of the bulb 18 is conventionally mounted in a socket 29, which socket is sealingly carried by the insert 20, and which socket is conventionally connected to the navigation light circuit (not shown) by a wire 30.

As shown in FIG. 1, the forward end of the insert 20 has a forwardly projecting tang 31 thereon, which tang, when the insert is in its projecting position shown in FIG. 1, engages a resilient, shock absorbent bumper 32. Front resilient means in the form of a recurved leaf spring 33 is secured to the front of the base plate 14 by a screw 34 and extends rearwardly therefrom to engage the forward underside of the tang 31, thereby to resiliently hold the insert in its projecting position.

As shown in FIG. 1, the rearward lower end of the insert 20 has a downwardly projecting tang 35 which, when the insert is moved to its position shown in FIG. 2, engages the underside of the base plate 14 so that the top 36 of the insert when in the position shown in FIG. 2, is flush with the top of the base plate 14. Rear resilient means in the form of a recurved leaf spring 37 is secured to the rear of the base plate 14 by a screw 38 and extends forwardly therefrom to engage the rearward underside of the tang 35, thereby to resiliently hold the insert in its flush position.

The forward side of the base plate 14 adjacent to the opening 21 therein has a downwardly and rearwardly facing angled slot 39 formed therein, while the insert, 20 as seen in FIG. 2, has an indentation 40 formed therein, which indentation is in registration with the slot 39 when in the position shown in FIG. 2. To raise the insert from its flush position of FIG. 2, one merely places a finger in the slot 39 and engages the indentation 40 and moves the insert to its projecting position shown in FIG. 1. To return the insert 20 to its flush position of FIG. 2, one merely presses on the top 36 of the insert and pushes forwardly thereon until it is flush with the base plate 14.

Figure 5:
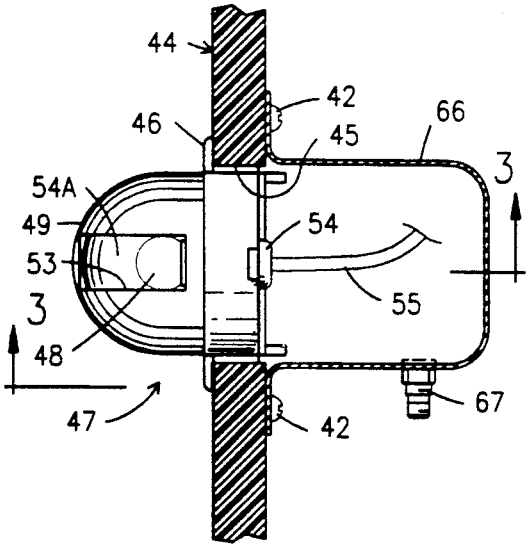
FIG. 5 is a sectional view of the embodiment of FIG. 3 taken along the lines 5—5 in FIG. 3.

A water collecting cup 41 is secured to the underside of the deck 10 by a plurality of screws, as seen at 42 in FIG. 5, and a drain connector 43 is secured in the bottom of the cup 41. A hose, not shown, connects the connector 43 to the bilge of the boat to drain any water which may collect in the cup 41 after passing through the assembly 16.

Referring now to FIGS. 3–6 wherein a second embodiment of this invention is shown, the side wall 44 of a boat cabin has an opening 45 therein. Inserted in the opening 45 is a base plate 46 of a side light assembly 47 which also includes a bulb 48 carrying insert 49. The base plate 46 is secured to the wall 44 by a plurality of screws 26, which screws pass through a flange of said base plate and into the wall 44. The insert 49 is pivotally mounted in a registering opening 50 in the base plate 46 by a pivot pin 51 which passes through an opening 52 which passes vertically through the insert at the rear inner end thereof. The insert 49 has a forwardly and sidewardly facing horizontal slot 53 formed therein, which slot extends for one hundred and twelve and one-half degrees. The slot 53 is covered by a plastic shield 54A with the shield on the starboard side of the boat being green and on the port side of the boat being red. The base (not shown) of the bulb 48 is conventionally mounted in a socket 54, which socket is sealingly carried by the insert 49 and which socket is conventionally connected to the navigation light circuit (not shown) by a wire 55.

Figure 3:
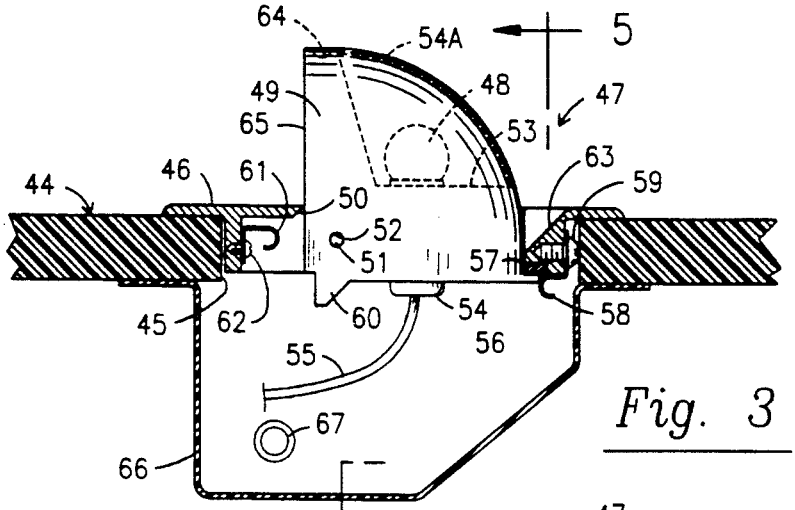
FIG. 3 is a plan view of a second embodiment of this invention, a side light, with the base plate and water retention cup shown in section and with the insert in its operative or projecting position and being shown in full lines, this view being taken along lines 3—3 in FIG. 5.

As shown in FIG. 3, the forward end of the insert 49 has a forwardly projecting tang 56 thereon, which tang, when the insert is in its projecting position shown in FIG. 3, engages a resilient, shock absorbing bumper 57. Front resilient means in the form of a recurved leaf spring 58 is secured to the front of the base plate 46 by a screw 59 and extends rearwardly therefrom to engage the forward inner side of the tang 56 thereby to resiliently hold the insert 49 in its projecting position. As shown in FIG. 3, the rearward inner end of the insert 49 has an inwardly projecting tang 60 which, when the insert 49 is moved to its position shown in FIG. 4, engages the underside of the base plate 46 so that the outside of the insert is flush with the top of the base plate. Rear resilient means in the form of a recurved leaf spring 61 is secured to the rear of the base plate 46 by a screw 62 and extends forwardly therefrom to engage the rearward innerside of the tang 60, thereby to resiliently hold the insert in its flush position.

Figure 4:
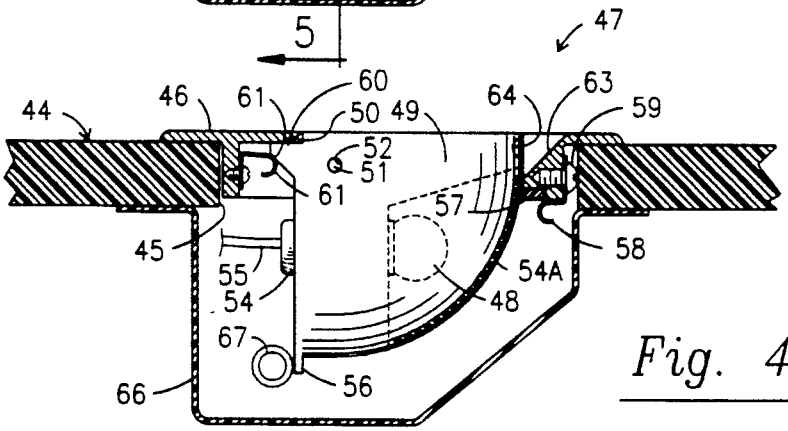
FIG. 4 is a view taken like FIG. 3 with the insert in its flush, inoperative position.

The forward end of the base plate 46 adjacent to the opening 50 therein has an inwardly and rearwardly facing angled slot 63 formed therein, while the insert 49, as seen in FIG. 4, has an indentation 64 formed therein, which indentation is in registration with the slot 63 when in the position shown in FIG. 4. To raise the insert 49 from its flush position of FIG. 4, one merely places a finger in the slot 63 and engages the indentation 64 and moves the insert to its projecting position shown in FIG. 3. To return the insert 49 to its flush position of FIG. 4, one merely presses on the back 65 and pushes forwardly until it pivots to be flush with the base plate 46.

A water collecting cup 66 is secured to the inner side of the side wall 44 by a plurality of screws 42 (see FIG. 5) and a drain connector 67 is secured in the bottom of the cup 66. A hose, not shown, connects connector 67 to the bilge of the boat to drain away any water which may collect in the cup 66 after passing through the assembly 47.

Although the above description relates to presently preferred embodiments, numerous modifications may be made therein without departing from the spirit of the invention as defined in the following claims.

What is claimed is:

1. A navigation light assembly having a flush position and a projecting position, which assembly is for mounting in conjunction with a hole formed in a boat comprising, a) a base plate including a flange overlying the hole in a boat and a portion extending into the hole, b) said base plate having an opening therein, c) a bulb carrying insert disposed in the opening in said base plate and including means pivotally mounting said insert to said base plate, d) said insert having a flush position wherein an outer surface of said insert is flush with an outer surface of said base plate and a projecting position wherein said insert projects out of said base plate, e) engagable means formed in said insert and accessible for moving said insert from its flush to its projected position, f) first resilient means carried by said base plate and engagable with an inner front end of said insert for engaging and resiliently holding said insert in its flush position, and g) second resilient means carried by said base plate and engageable with a rear end of the said insert for resiliently holding said insert in its projecting position.

2. An assembly accordingly to claim 1 including a water collecting cup surrounding the hole in the boat, means securing said cup to the boat and drain means connected to said cup, which drain means is accessible from outside of the cup.

3. An assembly according to claim 1 wherein said engageable means is an indentation formed in said insert, said base plate includes slot means formed therein and when said insert is in its flush position said indentation is accessible from said slot means.

* * * * *